United States Patent [19]

Anastasiou

[11] Patent Number: 5,029,460

[45] Date of Patent: Jul. 9, 1991

[54] RE-ENFORCER PLATE WITH DIFFERENT PATTERNS OF THREADED HOLES FOR LOCKS

[76] Inventor: George Anastasiou, 14-27 30 Dr., Astoria, N.Y. 11102

[21] Appl. No.: 382,383

[22] Filed: Jul. 20, 1989

[51] Int. Cl.[5] ..... E05B 9/08; E05B 15/02

[52] U.S. Cl. ..... 70/451; 70/452

[58] Field of Search ..... 70/451, 452, 381, 370, 70/461, 462, 466; 292/356, 357

[56] References Cited

U.S. PATENT DOCUMENTS

| | | | |
|---|---|---|---|
| 504,292 | 8/1893 | Badoni | 70/461 |
| 1,518,996 | 12/1924 | Maunder | 70/370 |
| 3,550,411 | 12/1970 | Neary et al. | 70/452 X |
| 3,645,045 | 2/1972 | Gervis et al. | 70/452 X |
| 4,688,409 | 8/1987 | Oliver et al. | 70/452 X |
| 4,708,007 | 11/1987 | Stoia | 70/452 X |
| 4,732,023 | 3/1988 | Shen | 70/383 |
| 4,751,834 | 6/1988 | Beck | 70/417 X |

FOREIGN PATENT DOCUMENTS

| | | | |
|---|---|---|---|
| 799147 | 11/1968 | Canada | 70/452 |
| 2026582 | 12/1971 | Fed. Rep. of Germany | 70/461 |
| 3610791 | 11/1986 | Fed. Rep. of Germany | 70/452 |

*Primary Examiner*—Lloyd A. Gall

[57] ABSTRACT

A guard for a door lock and cylinder is provided and consists of a face plate to cover and protect the cylinder while allowing a key to be inserted within the cylinder to operate the lock. The face plate prevents the lock from being separated from the door and is designed to receive bolts from typically four basic kinds of door locks so as to be a universal type of protector for the four locks.

3 Claims, 2 Drawing Sheets

FIG. 1
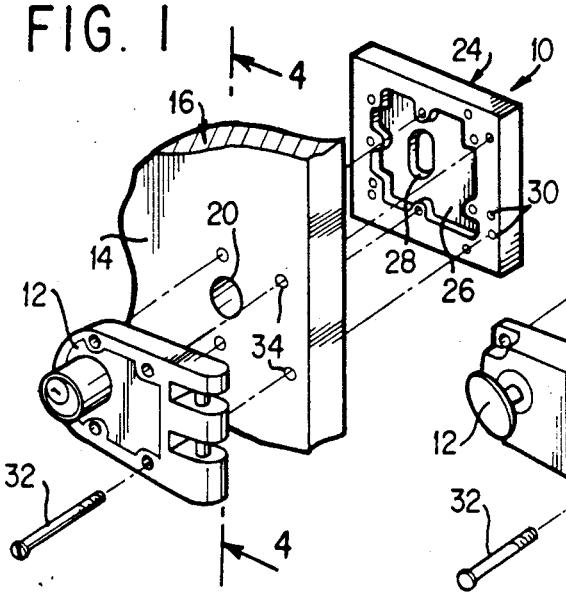
FIG. 2
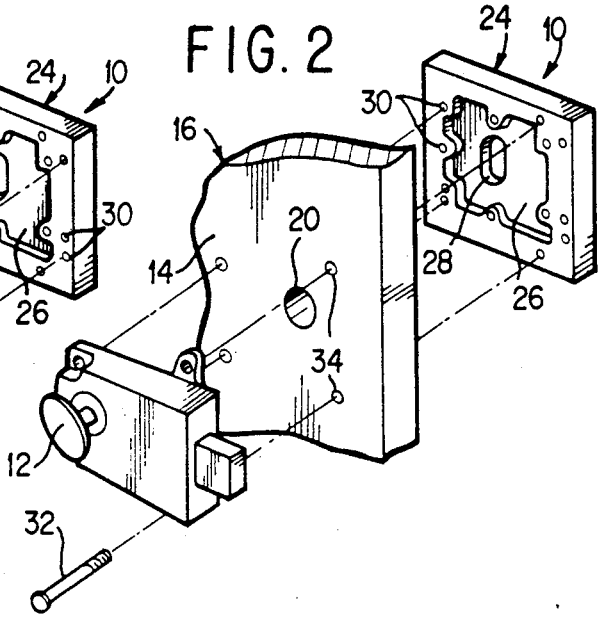
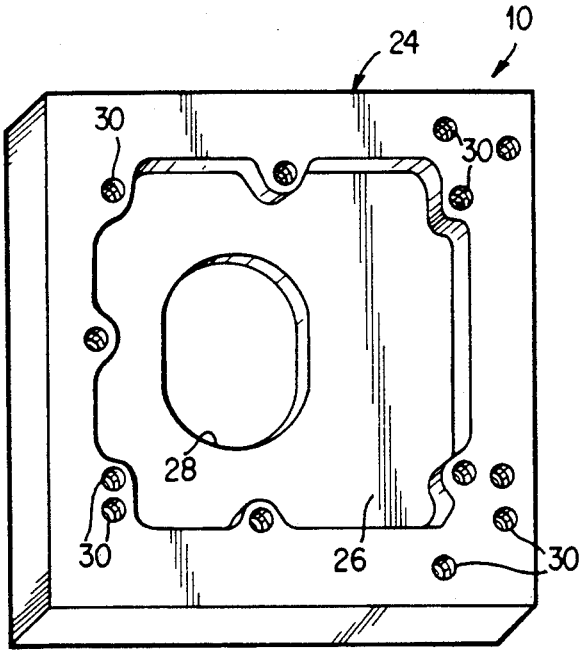
FIG. 3
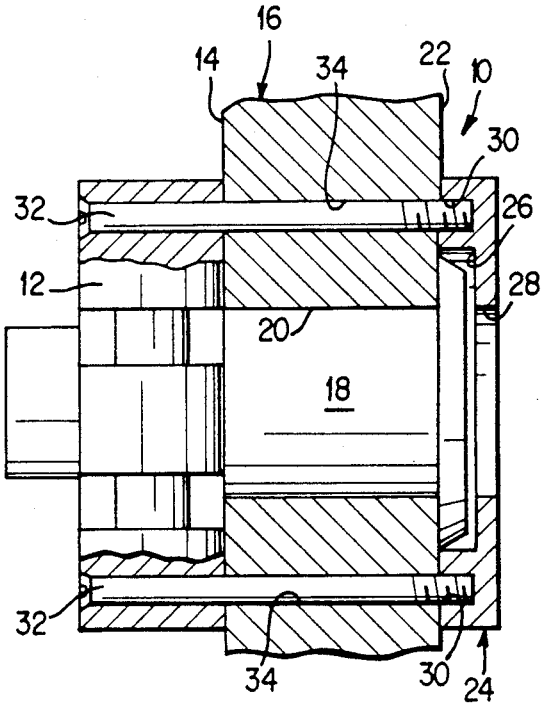
FIG. 4

RE-ENFORCER PLATE WITH DIFFERENT PATTERNS OF THREADED HOLES FOR LOCKS

BACKGROUND OF THE INVENTION

The instant invention relates generally to lock protectors and more specifically it relates to a guard for a door lock and cylinders. Standard door locks are secured to wooden doors by three or four wood screws. When the door is pushed hard enough, hit with a five pound hammer or kicked, the wood screws will rip out despite the construction and or cost of the lock. The lock will be separated from the door which will result in an unauthorized entry through the opened door.

Numerous lock protectors have been provided in the prior art that are adapted to cover locks and prevent the locks from being tampered with. For example U.S. Pat. Nos. 3,444,712 to Greenwald; 3,976,318 to Krus; 4,094,177 to Wellekens; 4,226,204 to Oliver and 4,484,463 to Hennessy all are illustrative of such prior art. While these units may be suitable for the particular purpose to which they address, they would not be as suitable for the purpose of the present invention as hereafter described.

SUMMARY OF THE INVENTION

A primary object of the present invention is to provide a guard for a door lock and cylinder that will overcome the shortcomings of the prior art devices.

Another object is to provide a guard for a door lock and cylinder that will cover and protect the cylinder of the lock on the outside of a door so as to prevent the lock from being separated from the door.

An additional object is to provide a guard for a door lock and cylinder in which a face plate is designed to receive bolts from at least four basic kinds of door locks so that the face plate will be a universal type of protector for each cylinder of the four locks.

A further object is to provide a guard for a door lock and cylinder that is simple and easy to use.

A still further object is to provide a guard for a door lock and cylinder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1, 2, 5 and 6 are partly exploded perspective views of the instant invention being used with various types of door locks;

FIG. 3 is a rear perspective view of the instant invention per se; and

FIG. 4 is a cross sectional view taken on line 4—4 in FIG. 1.

DETAILED DESCRIPTION OF THE PREFERRED EMBODIMENTS

Figure 5:
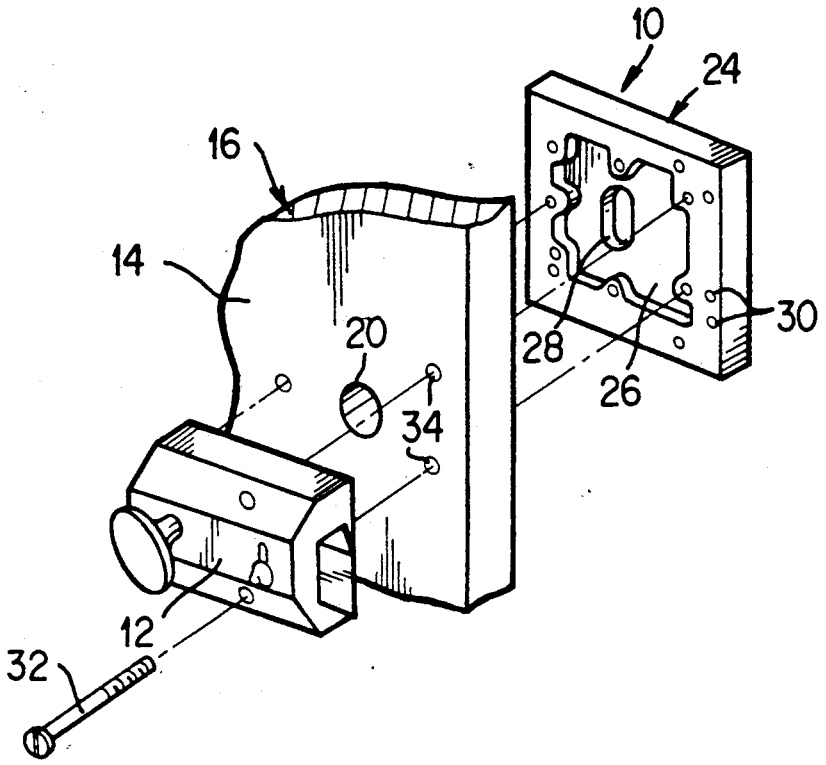
Figure 6:
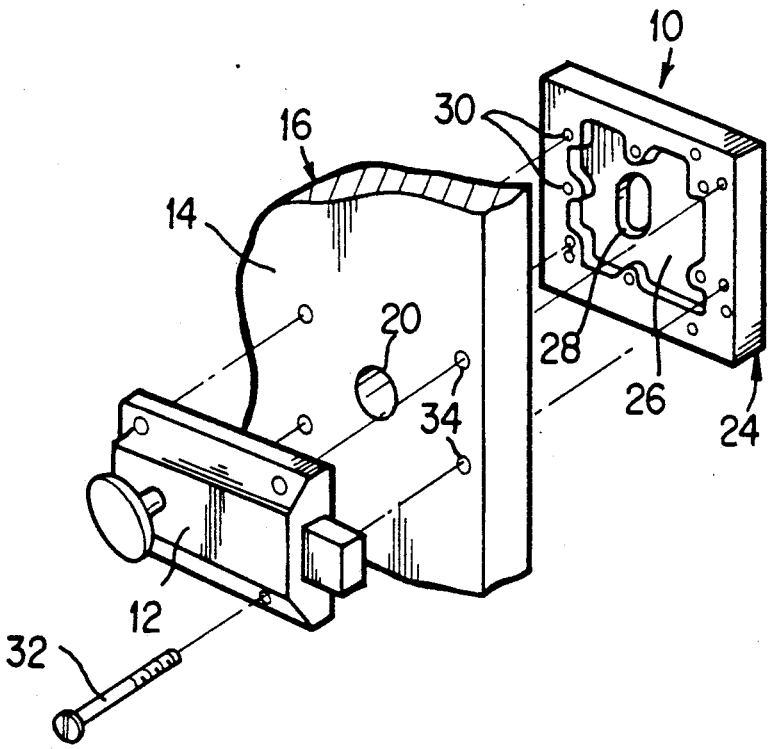

Turning now descriptively to the drawings, in which like reference characters denote like elements throughout the several views, the Figures illustrate a guard 10 for a lock 12 mounted on the inside surface 14 of a door 16 and a cylinder 18 extending inwardly through an aperture 20 to the lock 12 from the outside surface 22 of the door 16. The guard 10 consists of a face plate 24 having an inner recessed portion 26 provided with an aperture 28 therethrough. The inner recessed portion 26 will cover the cylinder 18 while the aperture 28 will be in alignment with the cylinder 18 thus allowing a key (not shown) to be inserted within the cylinder 18 to operate the lock 12.

The lock 12 is secured to the inside surface 14 of the door 16 and the face plate 24 to the outside surface 22 of the door 16 so as to prevent unauthorized tampering of the cylinder 18 and separation of the lock 12 from the door 16.

The face plate 24 has a plurality of spaced apart inner recessed threaded holes 30 placed about the inner recessed portion 26. A plurality of elongated bolts 32 are provided, each of which extends through the lock 12, a hole 34 in the door 16 and threaded into one of the threaded holes 30 in the face plate 24 so that the door 16 will be sandwiched between the lock 12 and the face plate 24.

The inner recessed threaded holes 30 are placed about the inner recessed portion 26 of the face plate 24 in predetermined patterns so that each of four basic kinds of door locks 12 can be used in conjuction with the bolts 32 and the face plate 24. The four basic kinds of door locks 12 are rim deadlock, night latch, bolt lock and dead bolt. The face plate 24 and the bolts 32 are fabricated out of hardened steel material.

To utilize the guard 10 for the lock 12 and cylinder 18 a person must drill the aperture 20 and the proper locations of holes 34 through the door 16. The cylinder 18 can be inserted through the outside surface 22 while the lock can be placed against the inside surface 14 of the door. The face plate 24 is then placed over the cylinder 18 and bolts 32 passed through bolt holes in the lock and door into the threaded holes 30 to assemble the lock and the face plate to the door, simultaneously.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A guard for at least two different basic kinds of locks having different patterns of mounting through-sockets for receiving elongate threaded anchoring members by which the locks can be mounted on the inside surface of a door and for cylinders extending inwardly to the locks from the outside surface of the door, said guard comprising:

a) a face plate having an inner recessed portion provided with an aperture therethrough so that inner recessed portion will cover the cylinder while said aperture will be in alignment with the cylinder thus allowing a key to be inserted into the cylinder to operate the lock;

b) a plurality of spaced apart, inner, recessed threaded holes formed in said face plate at locations around said inner recessed portion in at least two predetermined different patterns corresponding respectively to patterns of the through-sockets of at least two different basic kinds of locks; and, c) a plurality of bolts, each of which can extend through a through-socket, the door and be threaded into one of said threaded holes of a selected pattern of holes in said face plate so that the door will be sandwiched between the lock and said face plate with either one of at least two basic kinds of locks secured to the inside surface of the door and the face plate to the outside surface of the door simultaneously, so as to prevent unauthorized tampering with the cylinder and separation of the lock from the door.

2. A guard according to claim 1 wherein said predetermined different patterns of the mounting through-sockets are in a rim dead lock, a night latch, a bolt lock and a dead bolt.

3. A kit including a guard and at least two different kinds of locks having different patterns of mounting through-sockets for receiving elongate threaded anchoring members by which the locks can be mounted on the inside surface of a door and for cylinders extending inwardly to the locks form the outside surface of the door, said guard of said kit adapted for use with each of said locks and comprising:

a) a face plate having an inner recessed portion provided with an aperture therethrough so that said inner recessed portion will cover a cylinder while said aperture will be in alignment with the cylinder thus allowing a key to be inserted into the cylinder to operate a lock;

b) a plurality of spaced apart, inner, recessed threaded holes formed in said face plate at locations around said inner recessed portion in at least two pre-determined different patterns corresponding respectively to patterns of the through-sockets of said at least two different kinds of locks; and c) a plurality of bolts, each of which can extend through a through-socket of the lock, the door and be threaded into one of said threaded holes of a selected pattern of holes in said face plate so that the door will be sandwiched between the lock and said face plate with either one of said at least two kinds of locks secured to the inside surface of the door and the face plate to the outside surface of the door simultaneously, so as to prevent unauthorized tampering with the cylinder and separation of the lock from the door.

* * * * *